US011279167B2

(12) United States Patent
Moghadampour et al.

(10) Patent No.: US 11,279,167 B2
(45) Date of Patent: Mar. 22, 2022

(54) COMBINATIONAL TEMPLATE AND SCALE RULER FOR DRAWING PARALLEL 3-DIMENSIONS

(71) Applicants: Naser Moghadampour, Tehran (IR); Mardavij Tavakoli, Tehran (IR)

(72) Inventors: Naser Moghadampour, Tehran (IR); Mardavij Tavakoli, Tehran (IR)

( * ) Notice: Subject to any disclaimer, the term of this patent is extended or adjusted under 35 U.S.C. 154(b) by 173 days.

(21) Appl. No.: 16/819,134

(22) Filed: Mar. 15, 2020

(65) Prior Publication Data

US 2021/0283944 A1 Sep. 16, 2021

(51) Int. Cl.
*B43L 13/20* (2006.01)
*B43L 7/00* (2006.01)

(52) U.S. Cl.
CPC ..... *B43L 13/205* (2013.01); *B43L 7/005* (2013.01)

(58) Field of Classification Search
CPC ..... B43L 13/205; B43L 7/005
See application file for complete search history.

(56) References Cited

U.S. PATENT DOCUMENTS 2,713,205 A * 7/1955 Nielsen ..... B43L 13/205 33/479
3,604,118 A * 9/1971 Miller ..... B43L 13/205 33/474
4,205,849 A * 6/1980 Perkins ..... A63F 9/088 273/155
6,351,893 B1 * 3/2002 St. Pierre ..... B43L 13/201 33/16
6,357,130 B1 * 3/2002 Rank ..... B43L 13/14 33/1 K
7,055,259 B2 * 6/2006 Goldman ..... B43L 13/141 33/562
2006/0005411 A1 * 1/2006 Goldman ..... B43L 13/141 33/562
2021/0283944 A1 * 9/2021 Moghadampour ... B43L 13/205

FOREIGN PATENT DOCUMENTS

CN 107933162 A * 4/2018
CN 106827894 B * 4/2019
KR 101781001 B1 * 9/2017

* cited by examiner

*Primary Examiner* — Yaritza Guadalupe-McCall

(57) ABSTRACT

A combinational template and scale ruler to accurately draw three-dimensional (3D) drawing is disclosed. The scale ruler is a transparent plate, which includes a plurality of apertures disposed at a middle portion. Each aperture defines a substantially continuous linear aperture corresponding to a visible edge of 3D shape. A plurality of indicium is juxtaposed around each aperture to facilitate drawing of the 3D shape. The plurality of indicium is inscribed in surface of the scale ruler. The plurality of indicium is graduated to define angle and size factor of the aperture to facilitate drawing of the 3D shape. The plurality of indicium further includes 3D shape of a cube of the aperture. The plurality of indicium includes information regarding the classification of the 3D shape. The plurality of apertures is arranged in groups and subgroups of the groups based on a type of projection of the 3D shape.

11 Claims, 9 Drawing Sheets

COMBINATIONAL TEMPLATE AND SCALE RULER FOR DRAWING PARALLEL 3-DIMENSIONS

BACKGROUND OF THE INVENTION

Sketches are used by a variety of individuals within many professional, academic, and technical fields. Designers, teachers, architects, and engineers, for example, may utilize sketches to facilitate conceptualization of new products or ideas via three dimensional drawings. Three-dimensional computerized drawing tools are available to allows a user to draw three-dimensional images.

People such as professional illustrators are mostly relying on software drawing tools compared to traditional sketching. Traditional sketching involves drawing sketches with hands on the paper and after completing and correcting, the plans are transferred to computer. In traditional sketching, user, relies on standard drawing tools such as a compass, ruler, technical pen, and transfer screen, to measure distances and draw technical drawings and 3D shapes, for example, cubes, rectangular, straight triangular prism, triangular pyramid, and other 3D shapes with angles.

These standard drawing tools are inefficient and tedious for complex illustrations, especially while creating 3D views of objects on a paper or a board. Further, drawing 3D shapes in the shortest possible time is often quite difficult and also time-consuming to draw with exact angles and sizes. Drawing, utilizing three-dimensional computerized drawing tools, involves drawing sketches with hands on the screen of the device with his/her knowledge. Similar to traditional sketching, the software user also needs manual tools, knowledge, practice and skill. Hence, the user should be a trained professional to use any tool or traditional hand sketching.

However, the existing tools require some basic knowledge to draw 3D shapes and are complex to use. Therefore, there is a need to provide a combinational template and scale ruler that includes a combination of inscribed marks and apertures adapted to cooperate with each other so as to enable a user to readily and easily create professional three-dimensional shapes and drawings.

SUMMARY OF THE INVENTION

The present invention discloses a combinational template and scale ruler for three-dimensional drawing; this can also function and be used to draw and teach parallel three-dimensions. The combinational template and scale ruler is a combination of inscribed marks and apertures adapted to cooperate with each other so as to enable a user to readily draw three-dimensional shapes.

The combinational template and scale ruler comprise a transparent plate, a plurality of apertures and a plurality of indicium. The plurality of apertures is disposed at a middle portion of the transparent plate. Each aperture defines a substantially continuous linear aperture corresponding to a visible edge of the three-dimensional shape. Each aperture defines a substantially continuous linear aperture corresponding to a main axis of the three-dimensional shape.

In one embodiment, the plurality of apertures is arranged in groups and subgroups of the groups based on a type of projection of the three-dimensional shape. In another embodiment, the plurality of apertures is distributed in groups of axonometric, planometric and oblique projection. The plurality of apertures comprising an isometric type three-dimensional shape, a trimetric type three-dimensional shape and a dimetric type three-dimensional shape are arranged within the group of axonometric projection. The plurality of apertures comprising a cabinet type three-dimensional shape, a general type three-dimensional shape and a cavalier type three-dimensional shape are arranged within the group of oblique projection.

The plurality of indicium is juxtaposed around each aperture to facilitate drawing of the three-dimensional shape. The perimeter of the plate is inscribed with multiple units of linear scale markings. The plurality of indicium juxtaposed around each aperture is subscribed in surface of the plate and defines linear measurement. In one embodiment, three-dimensional shape of each aperture is juxtaposed around each aperture to facilitate drawing of the three-dimensional shape. In another embodiment, the plurality of indicium is graduated to define angle and size factor of the aperture to facilitate drawing of the three-dimensional shape. In yet another embodiment, the plurality of indicium includes information regarding the classification of the three-dimensional shape. In one embodiment, the plate has at least one of rectangular or square shape.

One aspect of the present disclosure is directed to a combinational template and scale ruler for three-dimensional drawing, comprising: a transparent plate; a plurality of apertures disposed at a middle portion of the transparent plate, each aperture defines a substantially continuous linear aperture corresponding to a visible edge of a three-dimensional shape; and a plurality of indicium juxtaposed around each aperture to facilitate drawing of the three-dimensional shape. In one embodiment, the plate comprises at least one of rectangular or square shape. In another embodiment, the perimeter of the plate is inscribed with multiple units of linear scale markings. In one embodiment, the plurality of indicium juxtaposed around each aperture is subscribed in surface of said plate and defines linear measurement.

In another embodiment, the plurality of indicium includes the three-dimensional shape of the corresponding aperture. In one embodiment, the plurality of indicium is graduated to define angle and size factor of the aperture to facilitate drawing of the three-dimensional shape. In another embodiment, the plurality of apertures is arranged in groups and subgroups of the groups based on a type of projection of the three-dimensional shape. In one embodiment, the plurality of indicium includes information regarding the classification of the three-dimensional shape.

In another embodiment, the plurality of apertures is distributed in groups of axonometric, planometric and oblique projection. In a related embodiment, the plurality of apertures comprising an isometric type three-dimensional shape, a trimetric type three-dimensional shape and a dimetric type three-dimensional shape are arranged within the group of axonometric projection. In another related embodiment, the plurality of apertures comprising a cabinet type three-dimensional shape, a general type three-dimensional shape and a cavalier type three-dimensional shape are arranged within the group of oblique projection.

Another aspect of the present disclosure is directed to a combinational template and scale ruler for three-dimensional drawing, comprising: a transparent plate; a plurality of apertures disposed at a middle portion of the transparent plate, each aperture defines a substantially continuous linear aperture corresponding to a visible edge of a three-dimensional shape; and a plurality of indicium juxtaposed around each aperture to facilitate drawing of the three-dimensional shape, wherein the plate comprises at least one of rectangular or square shape, wherein the perimeter of the plate is inscribed with multiple units of linear scale markings, wherein the plurality of indicium is graduated to define angle, three-dimensional shape and size factor of the aperture to facilitate drawing of the three-dimensional shape, and wherein the plurality of apertures is arranged in groups and subgroups of the groups based on a type of projection of the three-dimensional shape.

In one embodiment, the plurality of indicium includes information regarding the classification of the three-dimensional shape. The plurality of apertures may, in one embodiment, be distributed in groups of axonometric, planometric and oblique projection. The plurality of apertures may comprise an isometric type three-dimensional shape, a trimetric type three-dimensional shape and a dimetric type three-dimensional shape are arranged within the group of axonometric projection. Alternatively, the plurality of apertures may comprise a cabinet type three-dimensional shape, a general type three-dimensional shape and a cavalier type three-dimensional shape are arranged within the group of oblique projection.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

The present invention generally relates to three-dimensional drawing. More particularly, the present invention relates to a combinational template and scale ruler for three-dimensional drawing.

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 2:
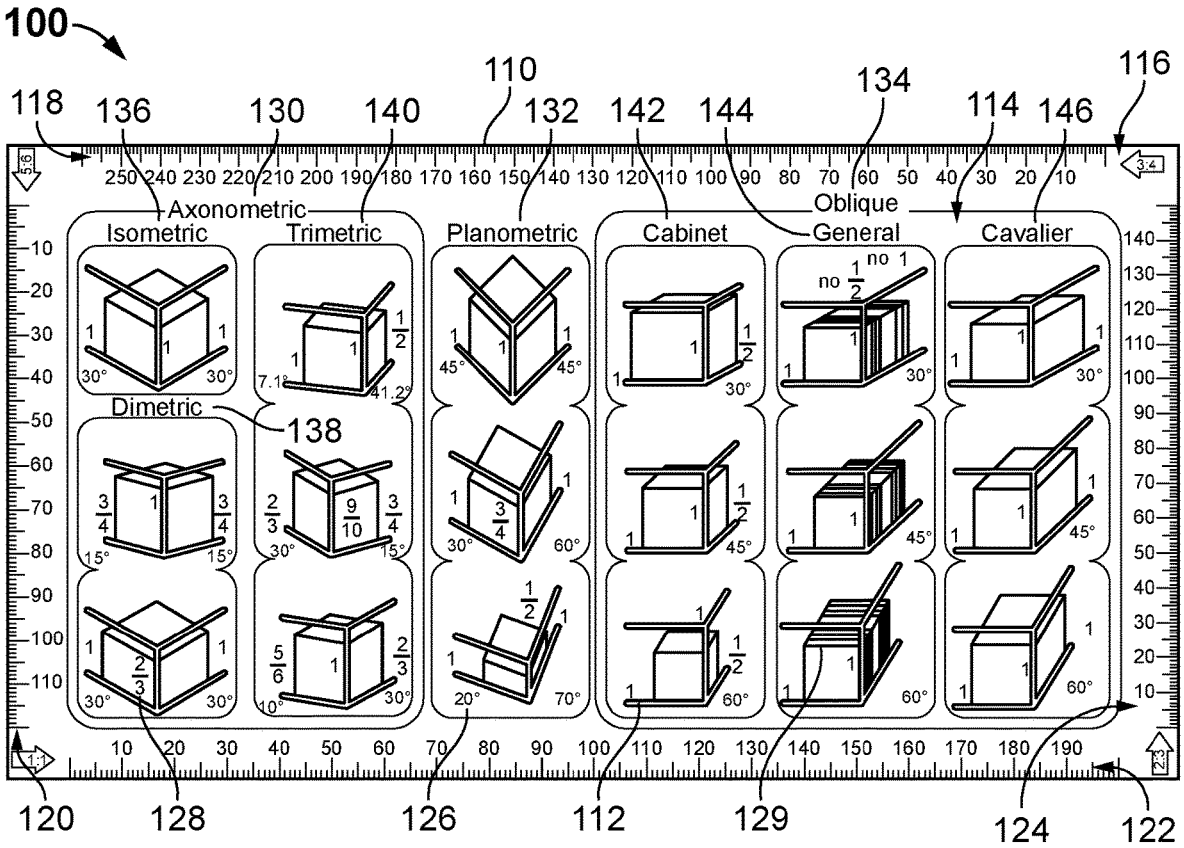
FIG. 2 exemplarily illustrates a combinational template and scale ruler, according to an embodiment of the present invention.

Referring to FIG. 2, the present invention discloses a combinational template and scale ruler 100 including a combination of inscribed marks and apertures 112 adapted to cooperate with each other so as to enable a user to readily draw three-dimensional shapes.

Figure 1:
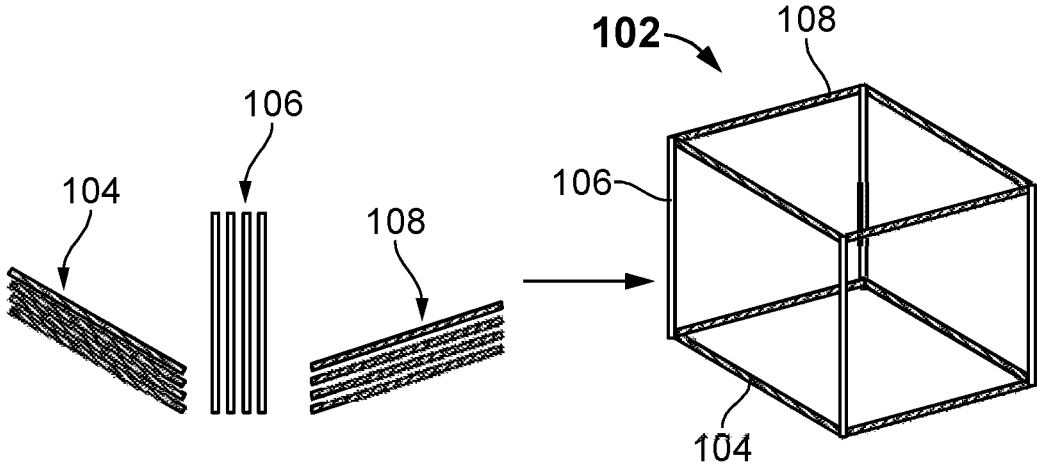
FIG. 1 exemplarily illustrates a cube formed with three groups of lines, according to an embodiment of the present invention.

Referring to FIG. 1, a cube 102 formed with three groups (104, 106, 108) of lines (104, 106, 108) in three axes perpendicular to each other. Each group (104, 106, 108) contain four lines. Consequently, the difference among three-dimensional shapes is because of the ratio of drawn angles of these three groups (104, 106, 108) of lines and the ratio of the declining each axis. The present invention is designed based on the standard of the angles of three main axes of the cube 102.

Referring to FIG. 2, the combinational template and scale ruler 100 comprises a transparent plate 110, a plurality of apertures 112 and a plurality of indicium. The plurality of apertures 112 are disposed at a middle portion 114 of the transparent plate 110. Each aperture 112 defines a substantially continuous linear aperture corresponding to a visible edge of the three-dimensional shape. Each aperture 112 defines a substantially continuous linear aperture corresponding to a main axis of the three-dimensional shape. A pencil or any other drawing tools are inserted to the aperture 112 to draw appropriate lines.

In one embodiment, the plurality of apertures 112 is arranged in groups and subgroups of the groups based on a type of projection of the three-dimensional shape. In another embodiment, the plurality of apertures 112 is distributed in groups of axonometric, planometric and oblique projection. The plurality of apertures 112 comprising an isometric type three-dimensional (3D) shape, a trimetric type three-dimensional shape and a dimetric type three-dimensional shape are arranged within the group of axonometric projection. The plurality of apertures 112 comprising a cabinet type three-dimensional shape, a general type three-dimensional shape and a cavalier type three-dimensional shape are arranged within the group of oblique projection.

The plurality of indicium is juxtaposed around each aperture 112 to facilitate drawing of the three-dimensional shape. The perimeter 116 of the plate 110 is inscribed with multiple units of linear scale markings (118, 120, 122, 124). The plurality of indicium juxtaposed around each aperture 112 is inscribed in surface of said plate 110 and defines linear measurement. In one embodiment, three-dimensional shape of each aperture 112 is juxtaposed around each aperture 112 to facilitate drawing of the three-dimensional shape.

In one example, the plurality of indicium is graduated to define angle 126 and size factor 128 of the aperture 112 to facilitate drawing of the three-dimensional shape. In yet another embodiment, the plurality of indicium includes information regarding the classification of the three-dimensional shape. In one embodiment, the plate 110 is at least one of rectangular or square shape. In one embodiment, the plurality of indicium is printed or carved on the scale ruler 100.

Figure 3:
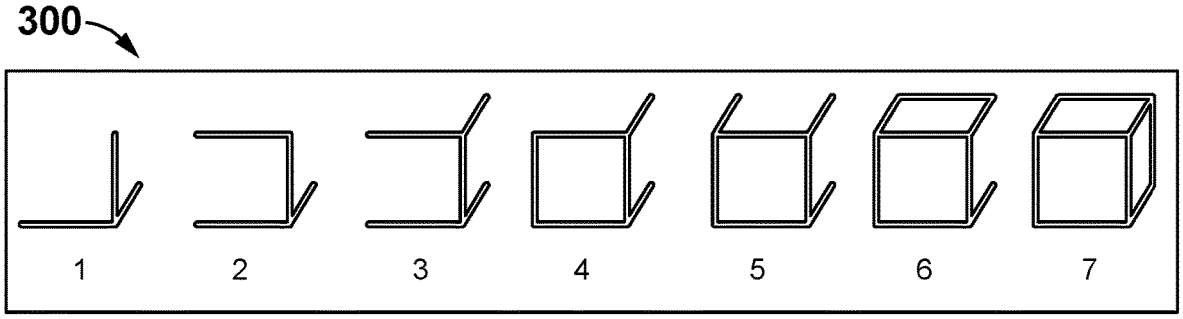
FIG. 3 exemplarily illustrates the various stages of drawing a cube utilizing the combinational template and scale ruler, according to an embodiment of the present invention.
Figure 4:
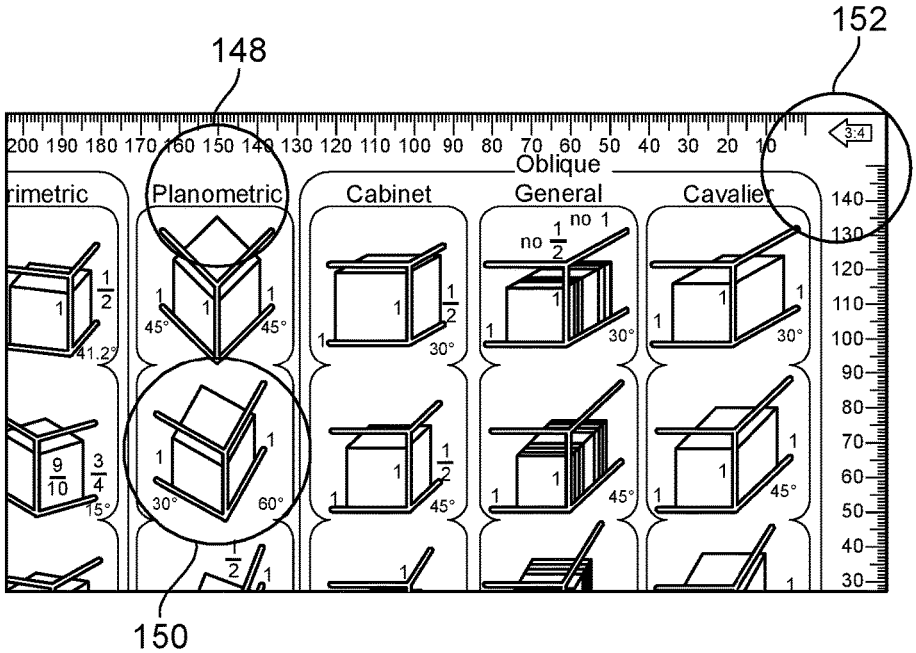
FIG. 4 exemplarily illustrates the usage of parts of the combinational template and scale ruler to draw planometric cube, according to an embodiment of the present invention.

Referring to FIG. 3, various stages 300 of drawing a cube utilizing the combinational template and scale ruler is disclosed. At stage 1, a main angle of a cube is created utilizing the aperture 112 of the scale ruler 100. At stage 2 to 7, parallel lines along the main angle are drawn to form the cube. FIG. 4 exemplarily illustrates usage of parts (150, 152, 148) of the combinational template and scale ruler 100 to draw planometric cube, according to an embodiment of the present invention. Referring to FIG. 4, to draw planometric cube with 60-degree and 30-degree angles, there are three main axes including two 1:1 scale (right and left sides) and one 3:4 axis (height axis). Left and right axes do not need any scale and the height axis needs to use the scale of 3:4.

Figure 5:
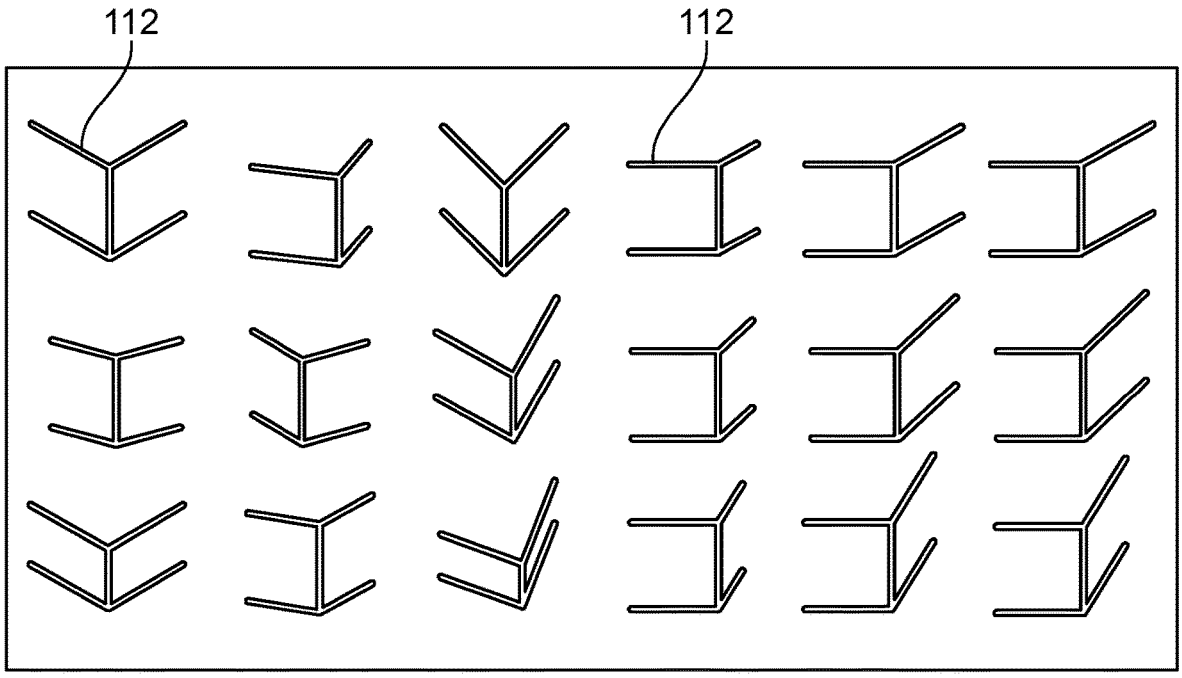
FIG. 5 exemplarily illustrates a plurality of apertures of the combinational template and scale ruler, according to an embodiment of the present invention.
Figure 6:
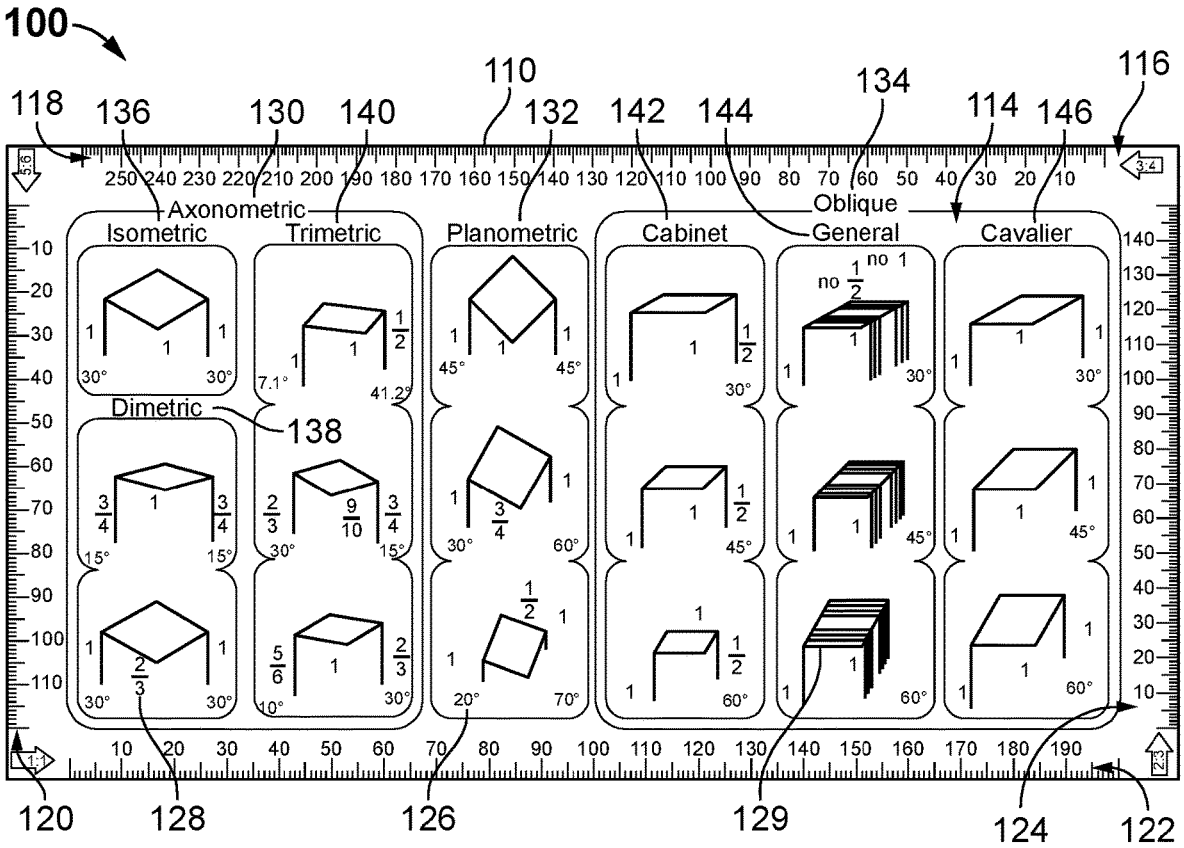
FIG. 6 exemplarily illustrates the combinational template and scale ruler without the apertures, according to an embodiment of the present invention.

FIG. 5 exemplarily illustrates the plurality of apertures 112 of the combinational template and scale ruler 100, according to an embodiment of the present invention. The plurality of indicium in cooperation with the apertures 112 allow the user to readily create any desired angle of three-dimensional cube 129. FIG. 6 exemplarily illustrates the combinational template and scale ruler 100 without the apertures 112, according to an embodiment of the present invention.

Figure 7:
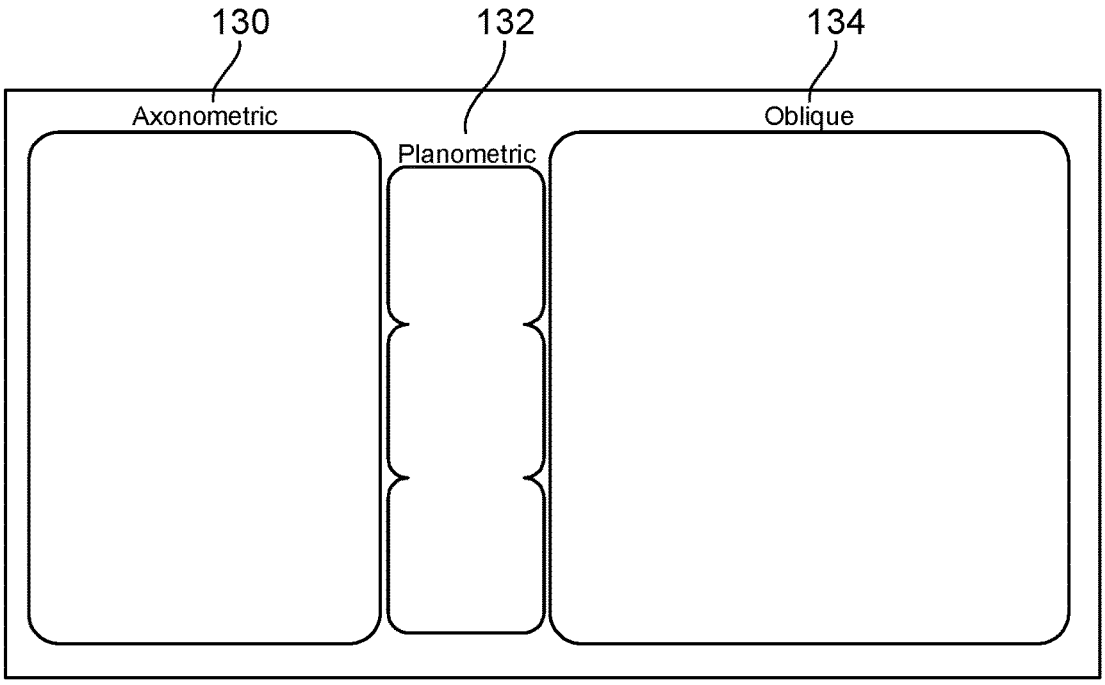
FIG. 7 exemplarily illustrates the groups of the plurality of apertures, according to an embodiment of the present invention.

FIG. 7 and FIG. 2 exemplarily illustrates groups of the plurality of apertures 112, according to an embodiment of the present invention. Regarding the classification of kinds of parallel 3Ds in three general categories, each category is divided into other subsets on the basis of characteristics and technical standards. Ratio of the angles of the three axes and decreasing factor in these three general categories has been calculated. For example, for drawing 3-D of the kind of cabinet 60 degrees, the section/part 150 shown on the scale ruler 100 must be used.

The plurality of apertures 112 is distributed on the surface of the plate 110. The plurality of apertures 112 corresponding to axonometric projection are grouped under the indicium of axonometric 130. The plurality of apertures 112 corresponding to planometric projection are grouped under the indicium of planometric 132. The plurality of apertures 112 corresponding to oblique projection are grouped under the indicium of oblique 134.

Figure 8:
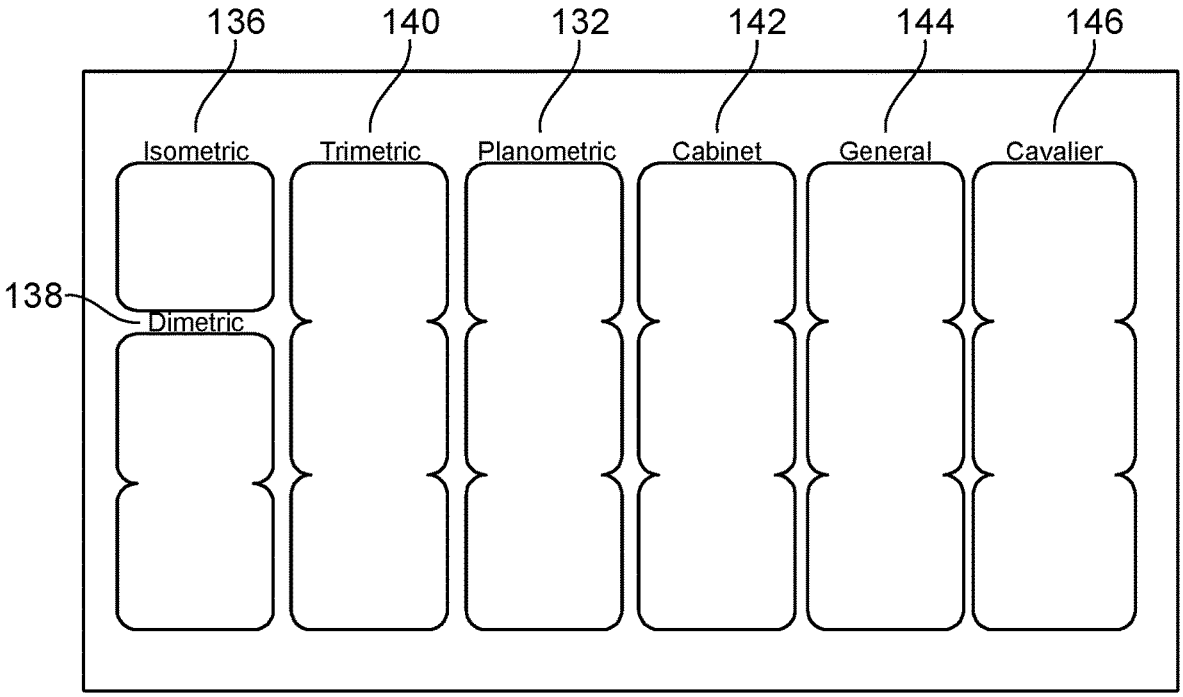
FIG. 8 exemplarily illustrates the sub-groups of the groups of the plurality of apertures, according to an embodiment of the present invention.

FIG. 8 and FIG. 2 exemplarily illustrates sub-groups of the groups of the plurality of apertures 112, according to an embodiment of the present invention. The plurality of apertures 112 corresponding to isometric type three-dimensional shape, a trimetric type three-dimensional shape and a dimetric type three-dimensional shape are arranged within the indicium of axonometric 130. The plurality of apertures 112 corresponding to isometric type three-dimensional shape are distributed under the indicium of isometric 136. The plurality of apertures 112 corresponding to the trimetric type three-dimensional shape are distributed under the indicium of trimetric 140. The plurality of apertures 112 corresponding to dimetric type three-dimensional shape are distributed under the indicium of dimetric 138.

The plurality of apertures 112 corresponding to the cabinet type three-dimensional shape, the general type three-dimensional shape and the cavalier type three-dimensional shape are distributed at the indicium of oblique 134. The plurality of apertures 112 corresponding to the cabinet type three-dimensional shape are distributed at the indicium of cabinet 142. The plurality of apertures 112 corresponding to the general type three-dimensional shape are distributed at the indicium of general 144. The plurality of apertures 112 corresponding to the cavalier type three-dimensional shape are distributed at the indicium of cavalier 146.

Figure 9:
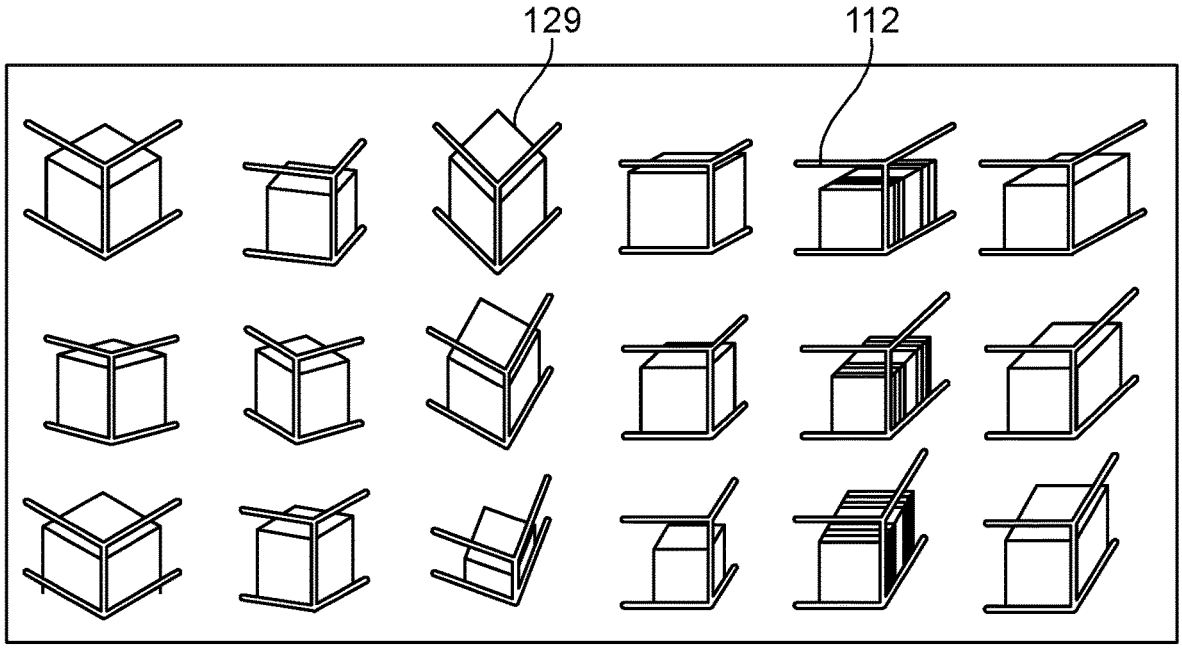
FIG. 9 exemplarily illustrates the indicium defining three-dimensional cube of corresponding aperture is juxtaposed around each aperture, according to an embodiment of the present invention.
Figure 10:
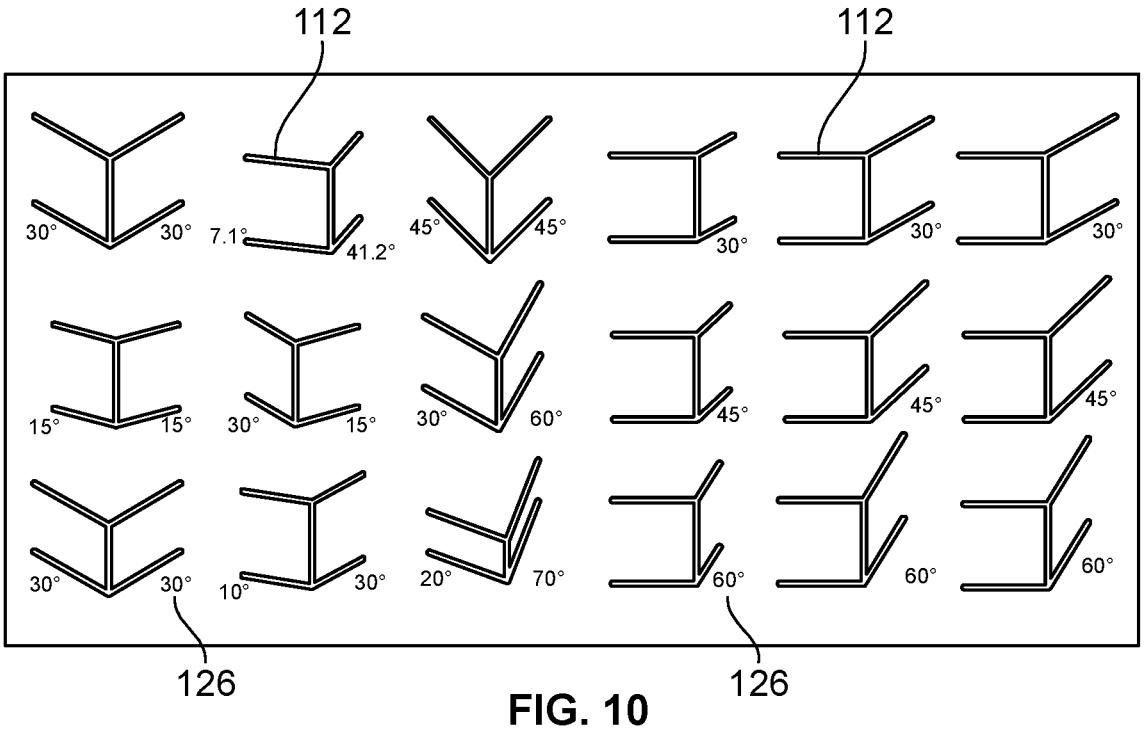
FIG. 10 exemplarily illustrates the indicium defining the angle of corresponding aperture is juxtaposed around each aperture, according to an embodiment of the present invention.
Figure 11:
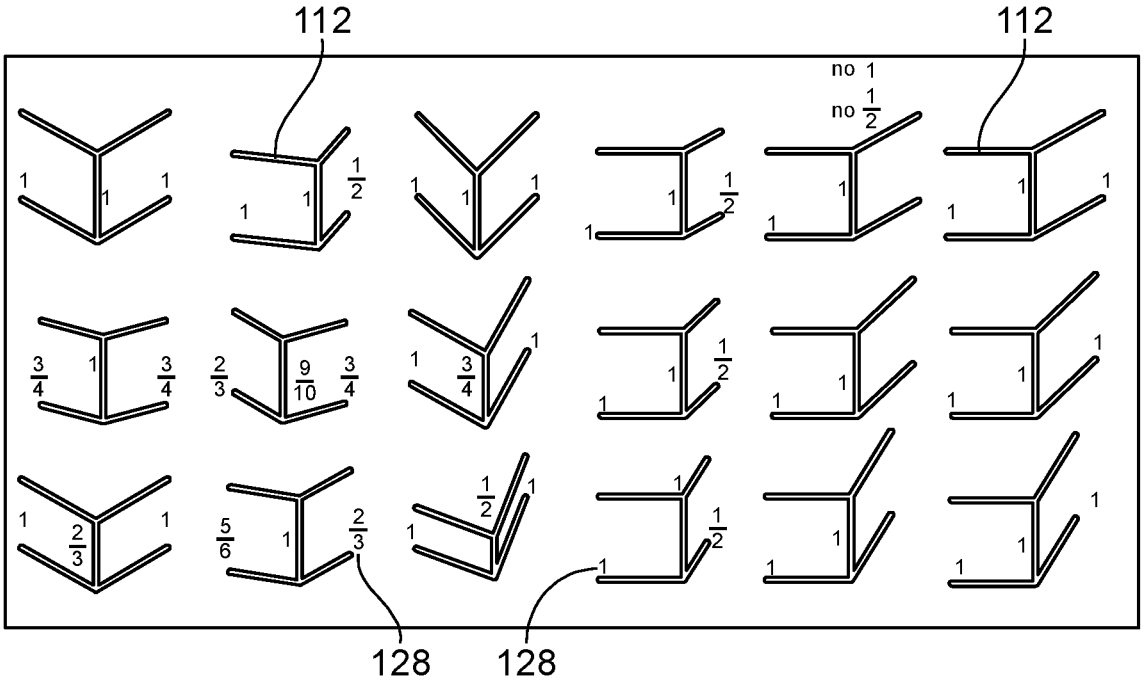
FIG. 11 exemplarily illustrates the indicium defining the size factor of corresponding aperture is juxtaposed around each aperture, according to an embodiment of the present invention.

Referring to FIG. 9 and FIG. 2, the indicium defining three-dimensional cube 129 of each aperture 112 is juxtaposed around each aperture 112. Referring to FIG. 10, the indicium defining the angle 126 of each aperture 112 is juxtaposed around each aperture 112, according to an embodiment of the present invention. Referring to FIG. 11, the indicium defining the size factor 128 of each aperture 112 is juxtaposed around each aperture 112, according to an embodiment of the present invention.

Figure 12:
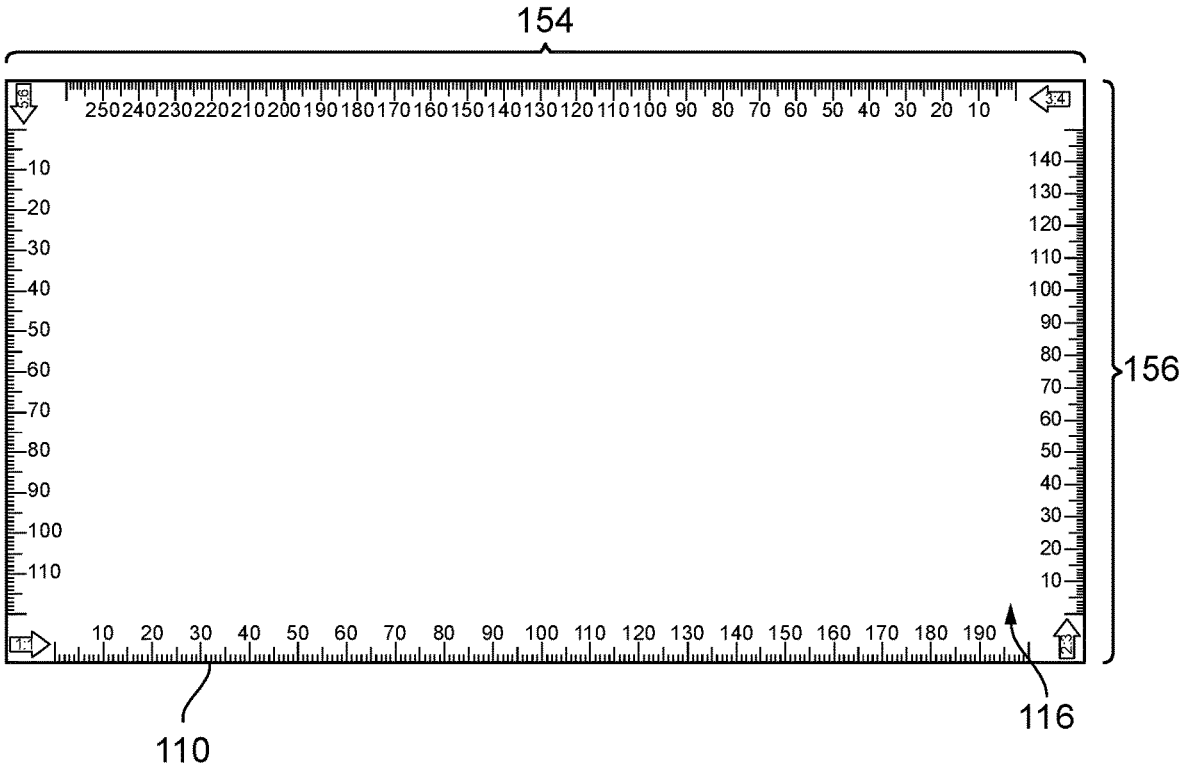
FIG. 12 exemplarily illustrates the perimeter of the plate inscribed with multiple units of linear scale markings, according to an embodiment of the present invention.

FIG. 12 exemplarily illustrates the perimeter 116 of the plate 110 inscribed with multiple units of linear scale markings (118, 120, 122, 124), according to an embodiment of the present invention. The linear scale markings (118, 120, 122, 124) includes 1:1 scale, 2:3 scale, 3:4 scale and 5:6 scale. The combinational template and scale ruler 100 is 120 mm in height, represented by numeral 156, and 220 mm in width, represented by numeral 154.

In one embodiment, the method of using the scale ruler 100 is disclosed. At first, the user needs to choose the main category. At second step, the 3D pattern specified among the subcategories of the main category is used to draw the main axes of the 3D pattern. To draw bigger cubes, all are axes continued to reach proper sizes. For this aim the related scale in the side of template ruler is used. 18 numbers of known and standard types of 3Ds are shown in the scale ruler 100.

The present invention enables to sketch parallel three-dimensional shapes quickly and accurately. The present invention enables the user to recognize any type of parallel three-dimension shapes. The present invention enables the user to draw three-dimensional shapes without practical skills or software programs. The present invention has the following characteristics and advantages compared with existing unrelated drawing tools: simplicity in structure; speed and ease of use; high precision in drawing three-dimensional shape; light, portable and good durability of the scale ruler 100; ease of production and low price relative to the efficiency and use of the scale ruler 100, and usage as a reference source for learning and remembering rules, sizes and proportions. The present invention provides knowledge and skill of three-dimensional drawings simultaneously. The scale ruler 100 is an exact scientific classification that provides complete details and information about three-dimension.

The present invention eliminates the need of frequent reference of scientific and educational resources. The present invention enables the user to accurately draw the angles and ratios of all types of parallel three-dimensional shapes. The combinational template and scale ruler 100 is targeted to customers including, but not limited to, educational system in art and engineering, experts in production designing, instructors and learners in the educational system, drawing experts in the production designing group.

Further, the combinational template and scale ruler 100 is targeted to customers including, but not limited to, students of different art and technical fields at technical high schools; engineering and art students in different branches of drafting; fields of engineering, production, project management and executive management; field of civil and building, transportation, structure; various fields of art including architecture, urban design, restoration, industrial design, graphics, handicrafts, design of cinema and theatre decoration and other fields of applied arts and visual arts. The combinational template and scale ruler 100 is further targeted to customers, including, but not limited to, independent engineering offices or subdivisions of technical units in manufacturing institutions, ateliers and art workshops and educational institutions.

The combinational template and scale ruler 100 enables precise, correct and quick drawing of parallel three-dimensional shapes and distinguish the types of the parallel three-dimensional shapes. In addition, during drawing initial sketches in the fields of art and industry, at first, sketches are drawn with hands on the paper and after completing and correcting, the plans are transferred to computer. So before using any software programs, the combinational template and scale ruler 100 could be used for drawing initial sketches.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

While the above is a complete description of the preferred embodiments of the invention, various alternatives, modifications, and equivalents may be used. Therefore, the above description and the examples should not be taken as limiting the scope of the invention, which is defined by the appended claims.

What is claimed is:

1. A combinational template and scale ruler for three-dimensional drawing, comprising:

a transparent plate;

a plurality of apertures disposed at a middle portion of the transparent plate, each aperture defines a substantially continuous linear aperture corresponding to a visible edge of a three-dimensional shape, and a plurality of indicium juxtaposed around each aperture to facilitate drawing of the three-dimensional shape, wherein the plurality of indicium includes information regarding the classification of the three-dimensional shape.

2. The combinational template and scale ruler of claim 1, wherein the plurality of apertures is distributed in groups of axonometric, planometric and oblique projection.

3. The combinational template and scale ruler of claim 2, wherein the plurality of apertures comprising an isometric type three-dimensional shape, a trimetric type three-dimensional shape and a dimetric type three-dimensional shape are arranged within the group of axonometric projection.

4. The combinational template and scale ruler of claim 2, wherein the plurality of apertures comprising a cabinet type three-dimensional shape, a general type three-dimensional shape and a cavalier type three-dimensional shape are arranged within the group of oblique projection.

5. A combinational template and scale ruler for three-dimensional drawing, comprising:

a transparent plate;

a plurality of apertures disposed at a middle portion of the transparent plate, each aperture defines a substantially continuous linear aperture corresponding to a visible edge of a three-dimensional shape, and a plurality of indicium juxtaposed around each aperture to facilitate drawing of the three-dimensional shape, wherein the plate comprises at least one of rectangular or square shape, wherein the perimeter of the plate is inscribed with multiple units of linear scale markings, wherein the plurality of indicium is graduated to define angle, three-dimensional shape and size factor of the aperture to facilitate drawing of the three-dimensional shape, and wherein the plurality of apertures is arranged in groups and subgroups of the groups based on a type of projection of the three-dimensional shape.

6. The combinational template and scale ruler of claim 5, wherein the plate comprises at least one of rectangular or square shape.

7. The combinational template and scale ruler of claim 5, wherein the perimeter of the plate is inscribed with multiple units of linear scale markings.

8. The combinational template and scale ruler of claim 5, wherein the plurality of indicium includes information regarding the classification of the three-dimensional shape.

9. The combinational template and scale ruler of claim 5, wherein the plurality of apertures is distributed in groups of axonometric, planometric and oblique projection.

10. The combinational template and scale ruler of claim 9, wherein the plurality of apertures comprising an isometric type three-dimensional shape, a trimetric type three-dimensional shape and a dimetric type three-dimensional shape are arranged within the group of axonometric projection.

11. The combinational template and scale ruler of claim 9, wherein the plurality of apertures comprising a cabinet type three-dimensional shape, a general type three-dimensional shape and a cavalier type three-dimensional shape are arranged within the group of oblique projection.

* * * * *